US007784414B1

(12) United States Patent
Torres

(10) Patent No.: US 7,784,414 B1
(45) Date of Patent: Aug. 31, 2010

(54) SHELVING SYSTEM

(76) Inventor: Raquel Torres, 145 Horn La., Levittown, NY (US) 11756

( * ) Notice: Subject to any disclaimer, the term of this patent is extended or adjusted under 35 U.S.C. 154(b) by 0 days.

(21) Appl. No.: 11/690,474

(22) Filed: Mar. 23, 2007

(51) Int. Cl.
*A47B 1/04* (2006.01)

(52) U.S. Cl. ..... 108/73; 108/85; 108/89

(58) Field of Classification Search ..... 108/102, 108/73, 143, 50.01, 64, 50.02, 67, 68, 65, 108/85, 89; 248/188.2, 188.9, 188.8; 312/195, 312/203, 261, 257.1, 205
See application file for complete search history.

(56) References Cited

U.S. PATENT DOCUMENTS

| | | | | | |
|---|---|---|---|---|---|
| 1,689,652 | A | * | 10/1928 | Warnock | 108/85 |
| 1,915,346 | A | * | 6/1933 | Wurm | 108/85 |
| 1,965,245 | A | * | 7/1934 | Lillard | 108/85 |
| 2,072,791 | A | | 3/1937 | Baer | |
| 2,098,233 | A | * | 11/1937 | Giles | 108/85 |
| 2,278,894 | A | | 4/1942 | Paulson | |
| 2,366,867 | A | | 1/1945 | Nichthauser | |
| 2,591,066 | A | * | 4/1952 | Hartman | 108/85 |
| 2,657,108 | A | * | 10/1953 | Lallier | 108/85 |
| 2,893,164 | A | | 7/1959 | Martin | |
| 2,933,850 | A | * | 4/1960 | Martin | 248/188.2 |
| 3,790,241 | A | * | 2/1974 | Messina | 312/195 |
| 3,916,802 | A | * | 11/1975 | Virtue et al. | 108/102 |
| 4,500,146 | A | * | 2/1985 | Peterson | 312/257.1 |
| 4,678,234 | A | * | 7/1987 | Wilson | 297/423.45 |
| 5,137,160 | A | * | 8/1992 | Santucci | 211/153 |
| 5,205,097 | A | * | 4/1993 | Harvey | 248/188.2 |
| 5,352,168 | A | * | 10/1994 | Wilkinson | 248/188.2 |
| 5,522,324 | A | * | 6/1996 | van Gelder et al. | 108/50.02 |
| 5,560,302 | A | * | 10/1996 | Diffrient et al. | 108/64 |
| 5,647,286 | A | | 7/1997 | Dunn | |
| 5,746,139 | A | * | 5/1998 | Villanueva | 108/92 |
| 5,791,259 | A | * | 8/1998 | Mansfield et al. | 108/6 |
| 5,943,967 | A | * | 8/1999 | Sherman | 108/102 |
| 6,012,185 | A | | 1/2000 | Woods et al. | |
| 6,230,909 | B1 | * | 5/2001 | Suter | 211/188 |
| 6,676,231 | B1 | * | 1/2004 | Kelley et al. | 108/50.01 |
| 6,877,826 | B2 | * | 4/2005 | Wood et al. | 312/205 |
| 7,404,609 | B2 | * | 7/2008 | Nielsen | 312/205 |

FOREIGN PATENT DOCUMENTS

| | | |
|---|---|---|
| DE | 404992 | 2/1999 |

* cited by examiner

*Primary Examiner*—José V Chen

(57) ABSTRACT

A shelving system includes a primary panel having a top side, a bottom side, a back edge, a front edge, a first lateral edge and a second lateral edge. The bottom side includes a plurality of guides. Each of a pair of secondary panels has an upper surface and a lower surface. A plurality of engaging members is attached to the upper surfaces of the secondary panels. The guides receive the engaging members and slidably couple the secondary panels to the primary panel. The secondary panels each have an inner edge and an outer edge. The outer edges are aligned with a respective one of the first or second lateral edges to define a stored position. The outer edges are extended outwardly from the primary panel to define an extended position. Each of the secondary panels has one of a pair of supports attached thereto.

8 Claims, 5 Drawing Sheets

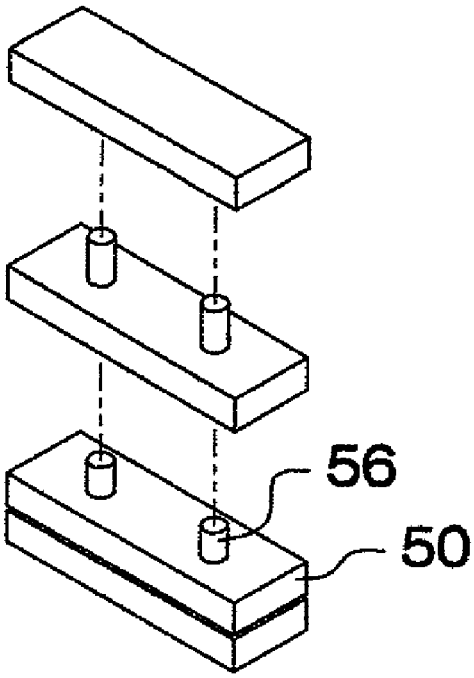
FIG. 6
FIG. 7
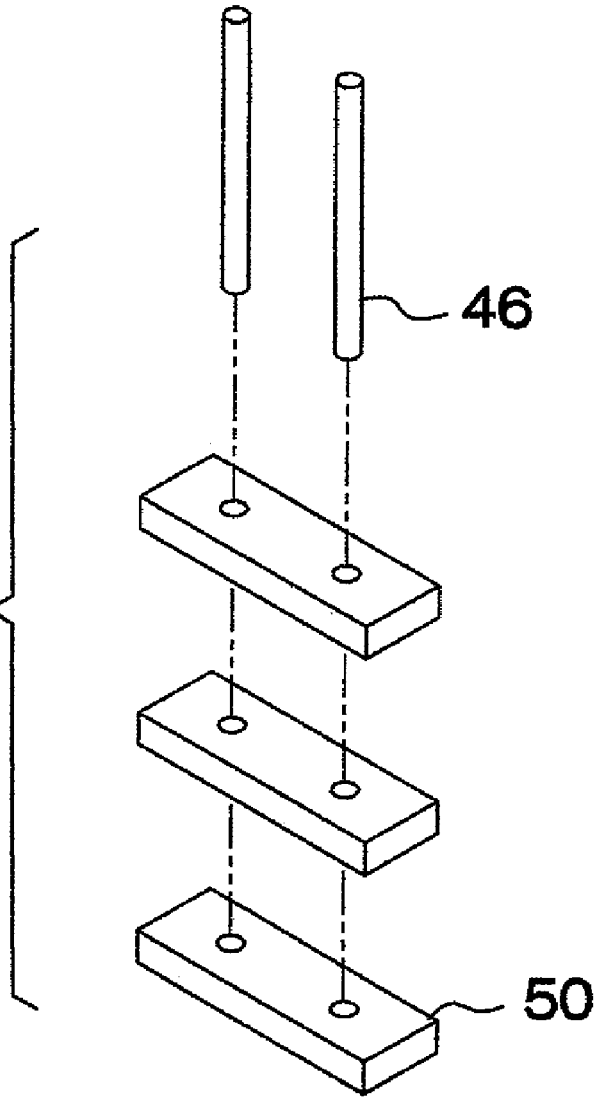

SHELVING SYSTEM

BACKGROUND OF THE INVENTION

1. Field of the Invention

The present invention relates to shelving devices and more particularly pertains to a new shelving device for allowing a person to adjust the height and length of a counter supporting shelf to accommodate a plurality of objects on and underneath the shelving device.

2. Description of the Prior Art

The use of shelving devices is known in the prior art. While these devices fulfill their respective, particular objectives and requirements, the need remains for a system that allows a person to selectively lengthen a shelf that may be positioned on a countertop for holding small canisters and the like. Further, the system should allow for selective height adjustments to allow items to be easily positioned beneath the system. Finally, the system may include a means for connecting together a plurality of shelving units.

SUMMARY OF THE INVENTION

The present invention meets the needs presented above by generally comprising at least one shelf assembly that includes a primary panel having a top side, a bottom side, a back edge, a front edge, a first lateral edge and a second lateral edge. The bottom side includes a plurality of guides. Each of a pair of secondary panels has an upper surface and a lower surface. A plurality of engaging members is engaged with one of the guide. Each of the upper surfaces of the secondary panels has two of the engaging members attached thereto. The guides receive one of the engaging members and slidably couple the secondary panels to the primary panel. The secondary panels each have an inner edge facing each other and an outer edge facing outwardly from each other. The outer edges are alignable with a respective one of the first or second lateral edges to define a stored position. The outer edges are extendable outwardly away from one of the first or second lateral edges to define an extended position. Each of the secondary panels has one of a pair of supports attached thereto and extending downwardly therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a perspective view of lifts of the present invention.

FIG. 7 is a perspective view of a second embodiment of supports of the present invention.

DESCRIPTION OF THE PREFERRED EMBODIMENT

Figure 1:
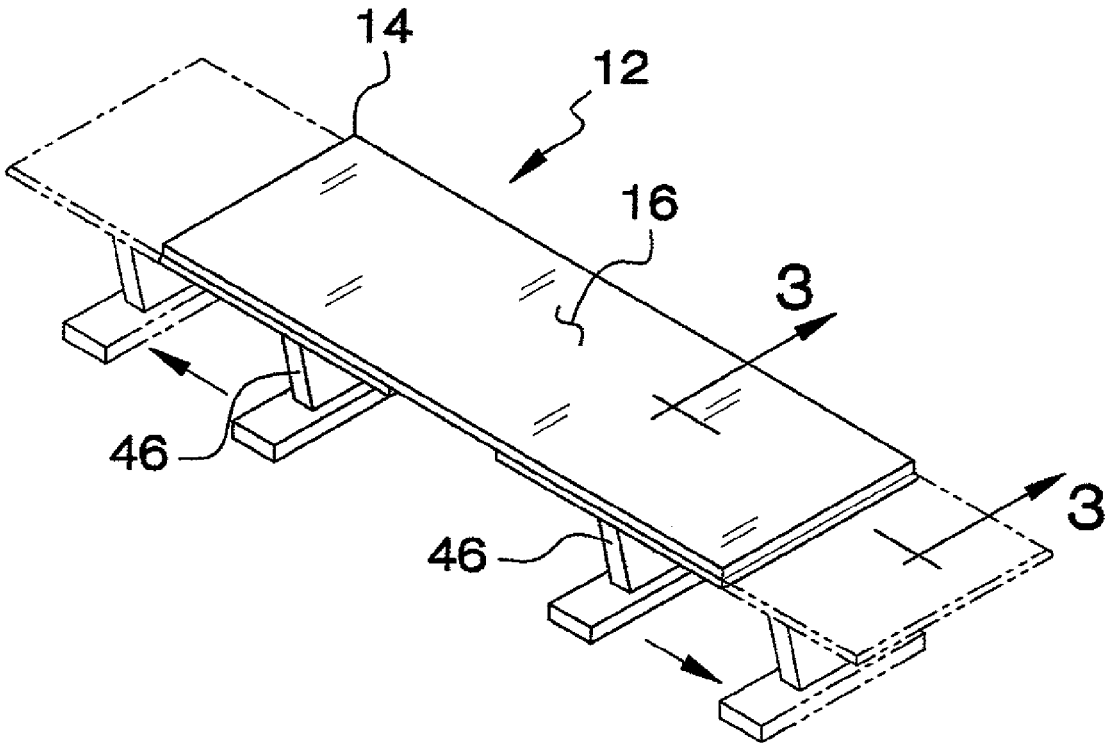
FIG. 1 is a perspective view of a shelving system according to the present invention.
Figure 2:
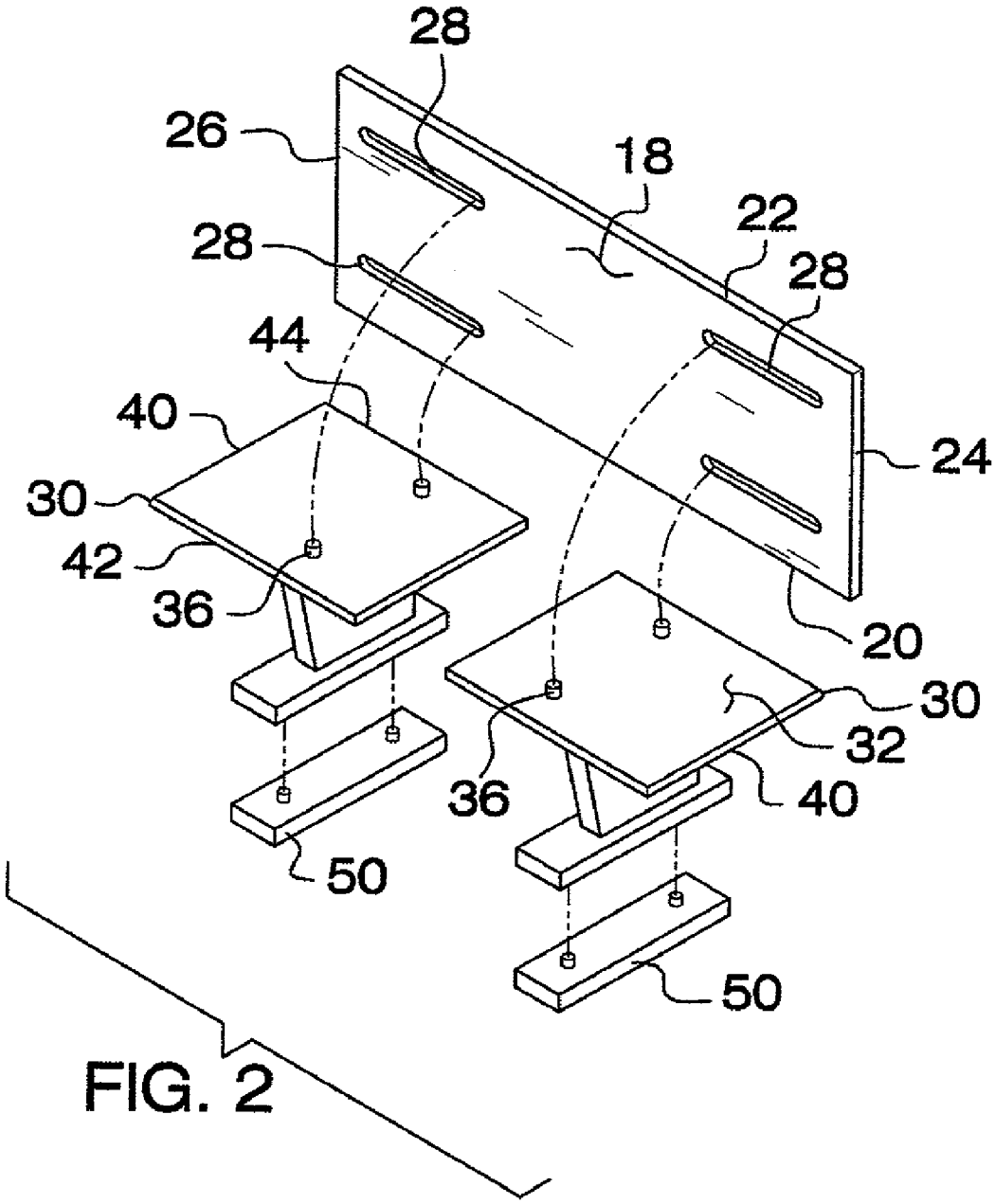
FIG. 2 is a perspective view of the present invention.
Figure 3:
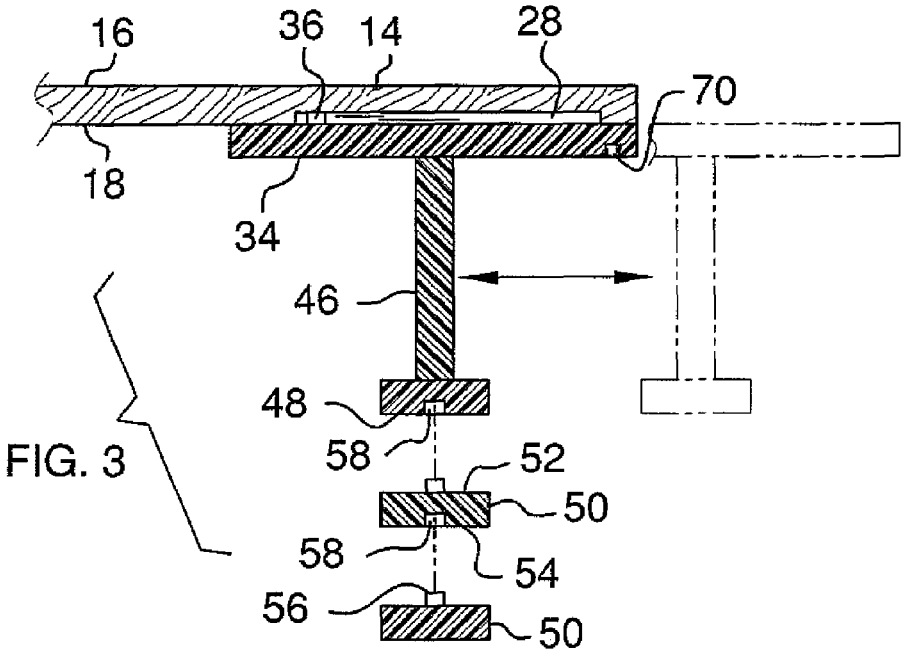
FIG. 3 is a cross-sectional view taken along line 3-3 of FIG. 1 of the present invention.
Figure 5:
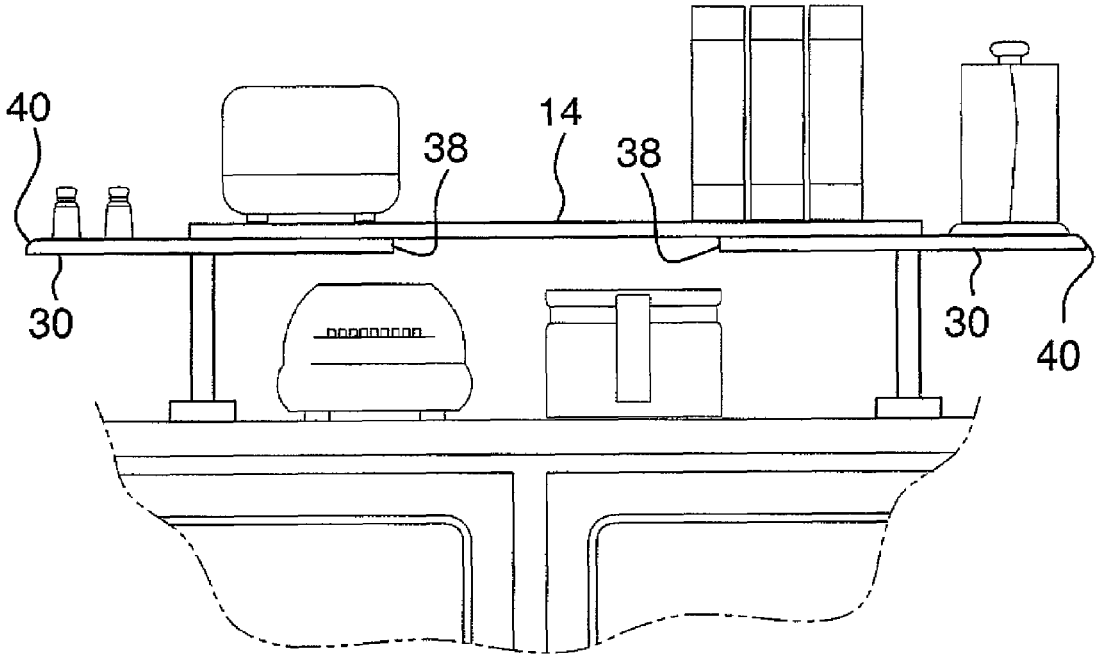
FIG. 5 is a front in-use view of the present invention.

With reference now to the drawings, and in particular to FIGS. 1 through 7 thereof, a new shelving device embodying the principles and concepts of the present invention and generally designated by the reference numeral 10 will be described.

As best illustrated in FIGS. 1 through 7, the shelving system 10 generally comprises at least one, and may include a pair of shelf assemblies 12. Each of the assemblies 12 includes a primary panel 14 that has a top side 16, a bottom side 18, a back edge 20, a front edge 22, a first lateral edge 24 and a second lateral edge 26. The bottom side 18 has a plurality of guides 28. Each of the guides 28 comprises an elongated trough orientated parallel to the front edge 22. A first pair of the guides 28 is positioned adjacent to the first lateral edge 24 and a second pair of guides 28 is positioned adjacent to the second lateral edge 26.

A pair of secondary panels 30 is provided with the shelf assembly 12. Each of the secondary panels 30 has an upper surface 32 and a lower surface 34. A plurality of engaging members 36 each is engaged with one of the guides 28. Each of the upper surfaces 32 of the secondary panels 30 has two of the engaging members 36 attached thereto and each of the guides 28 receives one of the engaging members 36 and slidably couples the secondary panels 30 to the primary panel 14. The secondary panels 30 each has an inner edge 38 facing each other and an outer edge 40 facing outwardly from each other. The outer edges 40 are alignable with a respective one of the first 24 or second 26 lateral edges to define a stored position. The outer edges 40 are extendable outwardly away from one of the first 24 or second 26 lateral edges to define an extended position. Each of the secondary panels 30 has a front edge 42 and a back edge 44 aligned with a respective one of the front 22 and back 20 edges of the secondary panel.

Each of the shelf assemblies 12 further includes a pair of supports 46. Each of the secondary panels 30 has one of the supports 46 attached thereto and extends downwardly therefrom. The supports 46 each have a distal end 48 with respect to the secondary panels 30. A plurality of lifts 50 selectively adjusts a height of the supports 46. The lifts 50 each have a first side 52 and a second side 54. Each of the first sides 52 has a plurality of pins 56 thereon. The pins 56 are extendable into wells 58 positioned in the distal ends 48 of the supports 46. At least two of the lifts 50 have a second side 54 having wells 58 extending therein for receiving the pins 56 of another one of the lifts 50. This allows a user to add multiple lifts 50 to each support 46. FIG. 7 shows a secondary version of the supports 46 and lifts 50 which may be used.

Figure 4:
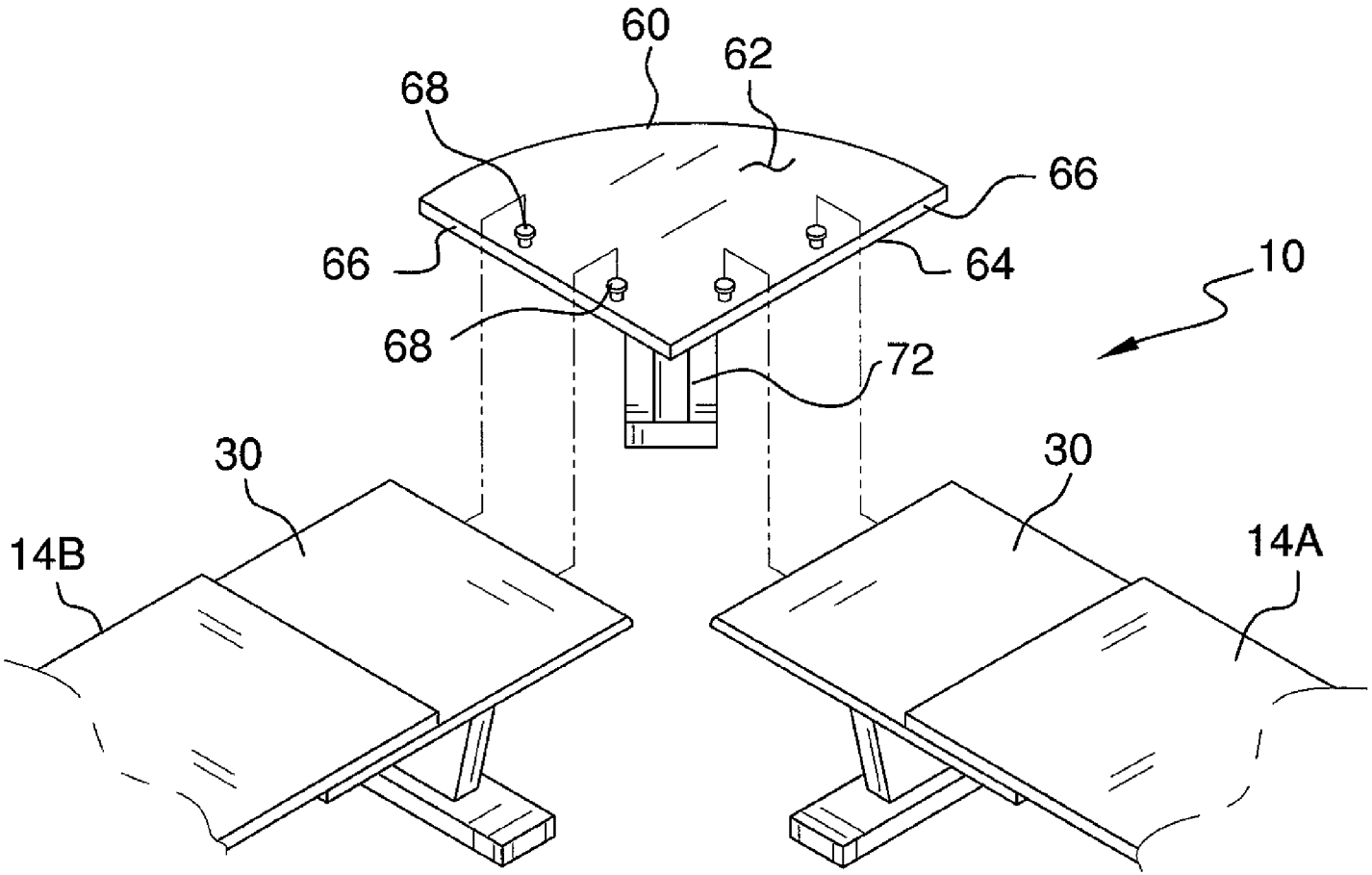
FIG. 4 is a perspective view of the present invention.

If two shelf assemblies 12 are used, as in FIG. 4, the system 10 may include a tertiary panel 60 that has a top face 62 and a bottom face 64. The tertiary panel 60 has a pair of forward edges 66 adjoining each other and are orientated approximately perpendicular to each other. A plurality of couplers releasably couples the top face 62 of the tertiary panel 60 to a pair of secondary panels 30 attached to two different primary panels 14A, 14B. Each of the couplers includes a male portion 68 and a female portion 70 that may be frictionally or snappily attached together. The male portions 68 are attached to the top face 62 and each of the forward edges 66 has one of the male portions 68 positioned adjacent thereto. The female portions 70 extend upwardly into a respective one of the secondary panels 30. The female portions 70 are positioned adjacent to a corresponding one of the outer edges 40. The two different primary panels 14A, 14B are orientated approximately perpendicular to each other in this embodiment. A leg 72 may be attached to the bottom face 64 of the tertiary panel 60 to ensure that it does not fall away from the secondary panels 30 when a heavy object is placed on the top face 62.

In use, the shelf assemblies 12 are adjusted as needed both vertically and longitudinally to support the required items to allow clearance for selected items. The supports 46 have a height between 4 inches and 8 inches but this can be increased with the lifts 50. The length of the primary panel 14 can be effectively increased by extending the secondary panels 30 outwardly from the primary panel 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An expandable shelf system comprising:

at least one shelf assembly including;

a primary panel having a top side, a bottom side, a back edge, a front edge, a first lateral edge and a second lateral edge, said bottom side including a plurality of guides;

a pair of secondary panels, each of said secondary panels having an upper surface and a lower surface;

a plurality of engaging members each being engaged with one of said guides, each of said upper surfaces of said secondary panels having two of said engaging members attached thereto, each of said guides receiving one of said engaging members and slidably coupling said secondary panels to said primary panel;

said secondary panels each having an inner edge facing each other and an outer edge facing outwardly from each other;

one of said secondary panels being positioned under and adjacent to said first lateral edge and one of said secondary panels being positioned under and adjacent to said second lateral edge, said secondary panels lying in a same horizontal plane with respect to each other, each of said secondary panels being slidable with respect to said primary panel to selectively adjust a distance between said outer edges of said secondary panels and said primary panel;

a pair of supports, each of said secondary panels having one of said supports attached thereto and extending downwardly therefrom.

2. The system according to claim 1, wherein each of said guides comprises an elongated trough orientated parallel to said front edge.

3. The system according to claim 1, wherein each of said secondary panels has a front edge and a back edge aligned with a respective one of said front and back edges of said secondary panel.

4. The system according to claim 1, further including a plurality of lifts to selectively adjust a height of said supports, each of said lifts having a first side and a second side, each of said first sides having a plurality of pins thereon, each of said supports having a distal end with respect to said secondary panels, said pins being extendable into wells positioned in said distal ends of said supports.

5. The system according to claim 4, wherein at least two of said lifts has a second side having wells extending therein for receiving the pins of another one of said lifts.

6. The system according to claim 1, further including:

said at least one shelf assembly including a pair of shelf assemblies;

a tertiary panel having a top face and a bottom face; and a plurality of couplers releasably coupling said top face of said tertiary panel to a pair of secondary panels attached to two different primary panels.

7. The system according to claim 1, wherein said tertiary panel has a pair of forward edges adjoining each other and being orientated approximately perpendicular to each other, each of said couplers including a male portion and a female portion, each of said male portions being attached to said top face, each of said forward edges having one of said male portions positioned adjacent thereto, each of said female portions extending upwardly into a respective one of said secondary panels, said female portions being positioned adjacent to a corresponding one of said outer edges, said two different primary panels being orientated approximately perpendicular to each other.

8. An expandable shelf system comprising:

a pair of shelf assemblies, each of said assemblies including;

a primary panel having a top side, a bottom side, a back edge, a front edge, a first lateral edge and a second lateral edge, said bottom side having a plurality of guides, each of said guides comprising an elongated trough orientated parallel to said front edge, a first pair of said guides being positioned adjacent to said first lateral edge and a second pair of guides being positioned adjacent to said second lateral edge;

a pair of secondary panels, each of said secondary panels having an upper surface and a lower surface;

a plurality of engaging members each being engaged with one of said guides, each of said upper surfaces of said secondary panels having two of said engaging members attached thereto, each of said guides receiving one of said engaging members and slidably coupling said secondary panels to said primary panel;

said secondary panels each having an inner edge facing each other and an outer edge facing outwardly from each other, one of said secondary panels being positioned under and adjacent to said first lateral edge and one of said secondary panels being positioned under and adjacent to said second lateral edge, said secondary panels lying in a same horizontal plane with respect to each other, each of said secondary panels being slidable with respect to said primary panel to selectively adjust a distance between said outer edges of said secondary panels and said primary panel, each of said secondary panels having a front edge and a back edge aligned with a respective one of said front and back edges of said secondary panel;

a pair of supports, each of said secondary panels having one of said supports attached thereto and extending downwardly therefrom, each of said supports having a distal end with respect to said secondary panels;

a plurality of lifts to selectively adjust a height of said supports, each of said lifts having a first side and a second side, each of said first sides having a plurality of pins thereon, said pins being extendable into wells positioned in said distal ends of said supports, at least two of said lifts having a second side having wells extending therein for receiving the pins of another one of said lifts;

a tertiary panel having a top face and a bottom face, said tertiary panel having a pair of forward edges adjoining each other and being orientated approximately perpendicular to each other; and a plurality of couplers releasably coupling said top face of said tertiary panel to a pair of secondary panels attached to two different primary panels, each of said couplers including a male portion and a female portion, each of said male portions being attached to said top face, each of said forward edges having one of said male portions positioned adjacent thereto, each of said female portions extending upwardly into a respective one of said secondary panels, said female portions being positioned adjacent to a corresponding one of said outer edges, said two different primary panels being orientated approximately perpendicular to each other.

* * * * *